US009522420B2

(12) United States Patent
Nonomura et al.

(10) Patent No.: US 9,522,420 B2
(45) Date of Patent: Dec. 20, 2016

(54) INCREMENTAL FORMING METHOD

(71) Applicants: Kiyoshi Nonomura, Nisshin (JP); Koji Kurozumi, Obu (JP); Koji Inoue, Aichi-gun (JP)

(72) Inventors: Kiyoshi Nonomura, Nisshin (JP); Koji Kurozumi, Obu (JP); Koji Inoue, Aichi-gun (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/390,414

(22) PCT Filed: Apr. 2, 2013

(86) PCT No.: PCT/IB2013/000574

§ 371 (c)(1),
(2) Date: Oct. 3, 2014

(87) PCT Pub. No.: WO2013/150360

PCT Pub. Date: Oct. 10, 2013

(65) Prior Publication Data

US 2015/0082854 A1 Mar. 26, 2015

(30) Foreign Application Priority Data

Apr. 5, 2012 (JP) ..... 2012-086600

(51) Int. Cl.
*B21D 31/00* (2006.01)

(52) U.S. Cl.
CPC ..... *B21D 31/005* (2013.01)

(58) Field of Classification Search
CPC ..... B21D 22/16; B21D 22/18; B21D 22/185; B21D 11/02; B21D 31/00; B21D 31/005
See application file for complete search history.

(56) References Cited

U.S. PATENT DOCUMENTS

| | | | | |
|---|---|---|---|---|
| 5,287,713 | A | 2/1994 | Mine et al. | |
| 5,333,484 | A | 8/1994 | Mine et al. | |
| 6,532,786 | B1 * | 3/2003 | Luttgeharm | 72/115 |
| 7,536,892 | B2 * | 5/2009 | Amino et al. | 72/305 |
| 2004/0148997 | A1 * | 8/2004 | Amino et al. | 72/297 |
| 2006/0272378 | A1 | 12/2006 | Amino et al. | |

(Continued)

FOREIGN PATENT DOCUMENTS

| | | | |
|---|---|---|---|
| CN | 1876266 | A | 12/2006 |
| DE | 4034625 | A1 | 5/1992 |

(Continued)

OTHER PUBLICATIONS

Greditor M.A., "Pressing operations and rotational pressing out," Machinebuilding, M., 1971, pp. 64-66. (from RU Ofc. Action. Jan. 18, 2016, partial translation of Office Action included).

*Primary Examiner* — Debra Sullivan
(74) *Attorney, Agent, or Firm* — Andrews Kurth Kenyon LLP

(57) ABSTRACT

An incremental forming method includes pressing a rod-shaped tool into a workpiece and stretching the workpiece little by little while moving the rod-shaped tool so that a percentage of decrease in plate thickness of the workpiece after forming with respect to plate thickness of the workpiece before forming is made to be within a range of 35% to 40%, inclusive.

1 Claim, 7 Drawing Sheets

(56) References Cited

U.S. PATENT DOCUMENTS

| | | | | |
|---|---|---|---|---|
| 2012/0024035 | A1* | 2/2012 | Kiridena | B21D 31/005 72/362 |

FOREIGN PATENT DOCUMENTS

| | | | |
|---|---|---|---|
| DE | 10303458 | A1 | 8/2004 |
| EP | 1147832 | A2 | 10/2001 |
| EP | 1477245 | A1 | 11/2004 |
| JP | 05-038526 | A | 2/1993 |
| JP | 05-057361 | A | 9/1993 |
| JP | H11-207413 | A | 8/1999 |
| JP | 2000-153313 | A | 6/2000 |
| JP | 2006-341262 | A | 12/2006 |

* cited by examiner

INCREMENTAL FORMING METHOD

CROSS-REFERENCE TO RELATED APPLICATIONS

This is a national phase application based on the PCT International Patent Application No. PCT/IB2013/000574 filed Apr. 2, 2013, claiming priority to Japanese patent application No. 2012-086600 filed Apr. 5, 2012, the entire contents of both of which are incorporated herein by reference.

BACKGROUND OF THE INVENTION

1. Field of the Invention

The invention relates to technology of an incremental forming method.

2. Description of Related Art

According to an incremental forming method, a rod-shaped tool is pressed into a metal plate (i.e., a workpiece) and the workpiece is stretched little by little while moving the rod-shaped tool, without using a die. The incremental forming method is well known as a method used to form a workpiece, which is suitable for low-volume production (see Japanese Patent Application Publication No. 2006-341262 (JP 2006-341262 A), for example).

However, when performing incremental forming on a workpiece that has been formed (i.e., processed) by press-forming, for example, the stress distribution balance between the front and the back of the workpiece ends up changing. As a result, the amount of dimensional change in the workpiece before and after incremental forming increases. Therefore, a forming method capable of reducing the amount of dimensional change in a workpiece before and after forming, when incremental forming is performed, is needed.

SUMMARY OF THE INVENTION

The invention thus provides an incremental forming method capable of reducing the amount of dimensional change before and after forming.

One aspect of the invention relates to an incremental forming method that involves pressing a rod-shaped tool into a metal plate and stretching the metal plate little by little while moving the rod-shaped tool. A percentage of decrease in plate thickness after incremental forming of the metal plate with respect to plate thickness before incremental forming of the metal plate is made to be within a range of 35% to 40%, inclusive.

The rod-shaped tool may have a hemisphere shape at a tip end portion of the rod-shaped tool, and a relationship among a radius of the tip end portion, a moving amount of one pass of the rod-shaped tool, and a pressing amount of the one pass of the rod-shaped tool may be expressed by an expression $$X = R - \sqrt{R^2 - \frac{P^2}{4}}$$

where R represents the radius, P represents the moving amount, and X represents the pressing amount.

Accordingly, the metal plate incremental forming method of the invention is capable of reducing the amount of dimensional change before and after forming.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
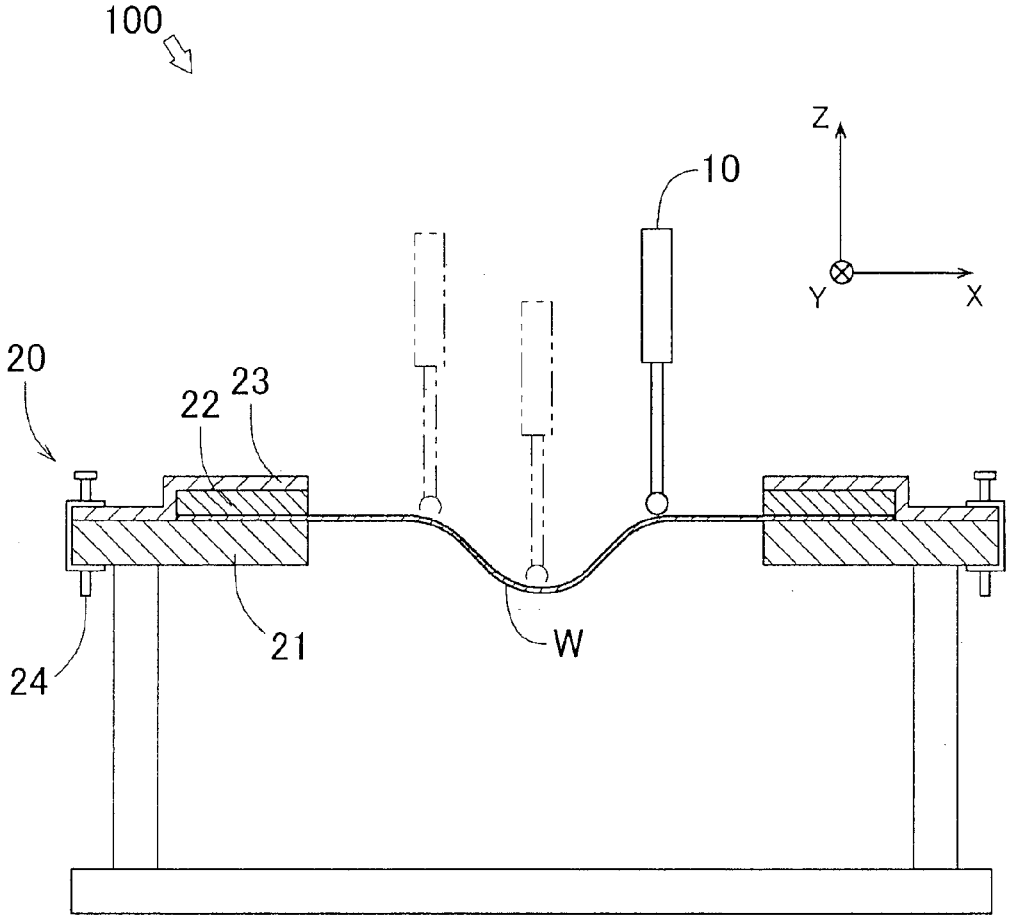
FIG. 1 is a block diagram of the general structure of an incremental forming apparatus according to one example embodiment of the invention.

An incremental forming apparatus 100 will now be described with reference to FIG. 1. FIG. 1 is a sectional block diagram of the incremental forming apparatus 100.

First, the structure of the incremental forming apparatus 100 will be described. The incremental forming apparatus 100 presses a rod-shaped tool (pressing tool) 10 into a workpiece W, and stretches the workpiece W little by little while moving the rod-shaped tool 10. The incremental forming apparatus 100 includes the rod-shaped tool 10 and a support device 20.

The workpiece W of this example embodiment is a part for a vehicle, which is formed from a metal plate. As will be described later, the workpiece W is formed (i.e., processed) by the incremental forming apparatus 100 in a final stage after being press formed by a press forming apparatus, not shown.

The rod-shaped tool 10 is pressed into the workpiece W, and stretches the workpiece W little by little while the rod-shaped tool 10 moves. The rod-shaped tool 10 is attached to an NC (Numerical Control) machine, not shown. An NC machine is a machining apparatus that operates according to numerical control. With an NC machine, operation of the rod-shaped tool 10 is defined by coordinate values in X, Y, and Z directions, and the workpiece W is formed by operating the rod-shaped tool 10 using a servo motor integrated in a machine tool, based on this information.

The support device 20 supports the workpiece W formed by the rod-shaped tool 10. The support device 20 includes a base 21, a buffer member 22, a cover plate 23, and a clamping jig 24.

The base 21 is a part on which a portion of the workpiece W that will not be formed (an edge portion of the workpiece W in this example embodiment) is placed. The buffer member 22 is arranged between the cover plate 23 and the workpiece W. The cover plate 23 presses on the portion of the workpiece W that will not be formed. The clamping jig 24 presses the cover plate 23 against the portion of the workpiece W that will not be formed, by clamping the cover plate 23 to the base 21.

Next, operation of the incremental forming apparatus 100 will be described. The portion of the workpiece W that will not be formed is fixedly supported by the support device 20, and the workpiece W is stretched little by little by the rod-shaped tool 10 controlled by an NC machine.

Figure 2:
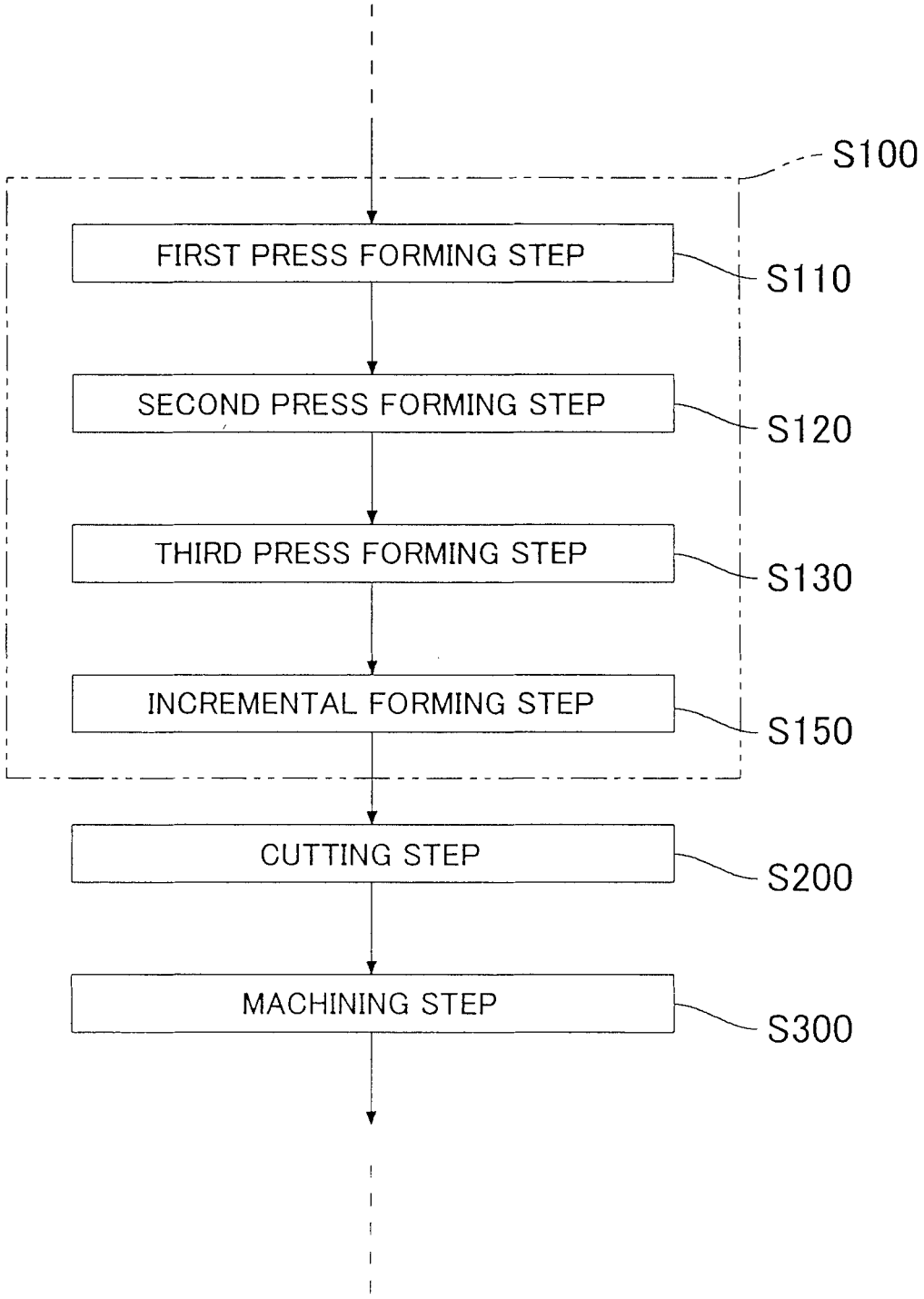
FIG. 2 is a flowchart illustrating the flow of forming steps according to the example embodiment of the invention.

The flow of a forming step S100 will now be described with reference to FIG. 2. FIG. 2 is a flowchart illustrating the flow of the forming step S100.

The forming step S100 is the forming method of the example embodiment of the invention. In the forming step S100, the workpiece W is formed. The forming step S100 includes press forming steps S110 to S130, and an incremental forming step S150. After the forming step S100, a cutting step S200 and a machining step S300 and the like are performed.

In the press forming steps S110, S120, and S130, the workpiece W is press formed by a pair of dies. Press forming includes bending or raising or the like. In this example embodiment, the plurality of press forming steps includes a first press forming step S110, a second press forming step S120, and a third press forming step S130, but is not limited to this.

The incremental forming step S150 is an example of the incremental forming method of the invention. In the incremental forming step S150, the workpiece W is formed by the incremental forming apparatus 100 described above. In the incremental forming step S150, the rod-shaped tool 10 is pressed into the workpiece W, and the workpiece W is stretched little by little while moving the rod-shaped tool 10.

The incremental forming step S150 includes not only a forming process for forming the workpiece W in the desired final shape in the forming step S100, but also a forming process for restoring a shape formed in the plurality of press forming steps S110 to S130 to its original shape (i.e., the shape before forming).

Here, it is worthy to note that the incremental forming step S150 is executed as the final step of the forming step S100, i.e., after all of the press forming steps S110 to S130 are complete.

Figure 3:
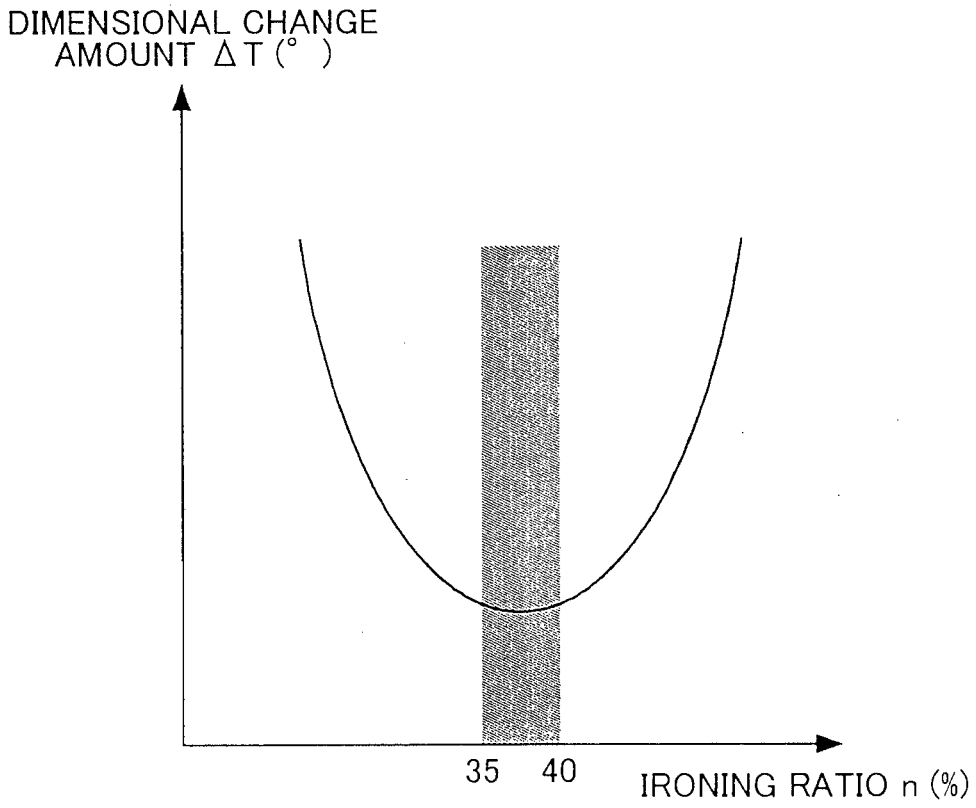
FIG. 3 is a graph showing the relationship between ironing ratio and an amount of dimensional change.

Next, an ironing ratio n of the incremental forming step S150 will be described with reference to FIG. 3. FIG. 3 is a graph showing the relationship between the ironing ratio n and an amount of dimensional change (hereinafter simply referred to as "dimensional change amount") ΔT.

The ironing ratio n is the percentage of decrease in the plate thickness before and after incremental forming, and can be expressed as shown in the expression below by a plate thickness T0 before incremental forming and a plate thickness T after incremental forming.

$$n = \frac{T0 - T}{T0} \times 100$$

The dimensional change amount ΔT represents the curve angle of a flat plate after incremental forming with respect to the flat plate before incremental forming. When the horizontal axis represents the ironing ratio n and the vertical axis represents the dimensional change amount ΔT, the relationship between the ironing ratio n and the dimensional change amount ΔT shows a quadratic curve having an inflection point near where the ironing ratio n becomes 35% to 40%. The dimensional change amount ΔT increases as the ironing ratio n decreases from this inflection point, and the dimensional change amount ΔT also increases as the ironing ratio n increases from this inflection point. In other words, the dimensional change amount ΔT is smallest when the ironing ratio n is near 35% to 40%.

In the incremental forming step S150 of this example embodiment, the workpiece W is formed such that the ironing ratio n falls within a range of 35% to 40%, inclusive (35%≤n≤40%). Therefore, the dimensional change amount ΔT of the workpiece W is able to be made as small as possible.

Figure 4:
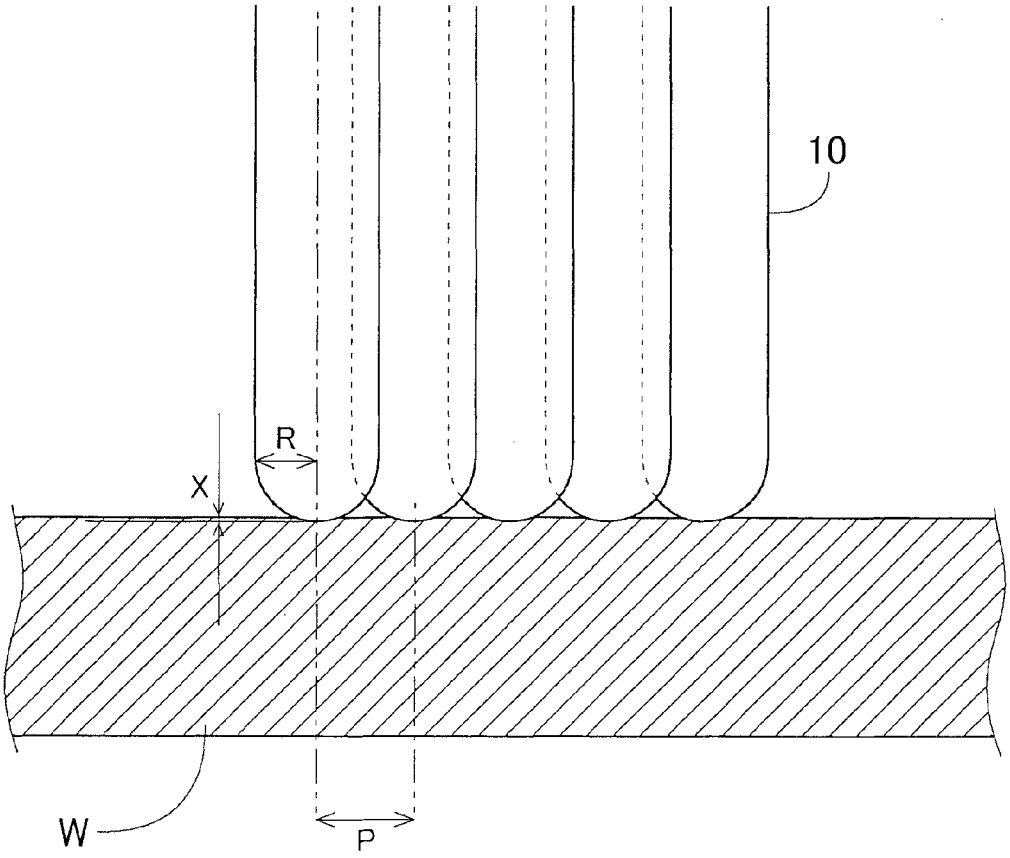
FIG. 4 is a sectional block diagram showing the relationship among a radius, a moving amount, and a pressing amount of a rod-shaped tool.

Next, the relationship among radius R, a moving amount P, and a pressing amount X of the rod-shaped tool 10 will be described with reference to FIG. 4. FIG. 4 is a sectional view in the moving direction (i.e., the horizontal direction) of the rod-shaped tool 10, of the flow of the incremental forming step S150.

Here, the rod-shaped tool 10 is formed by a round columnar rod-shaped member, and a tip end portion thereof that is pressed into the workpiece W is formed in a semispherical shape. The radius R of the rod-shaped tool 10 is the radius of the tip end portion that is formed in a semispherical shape. Also, the pressing amount X of the rod-shaped tool 10 is the amount that the tip end portion of the rod-shaped tool 10 is pressed into the workpiece W. That is, the pressing amount X of the rod-shaped tool 10 affects the finish of the surface after the workpiece W is formed.

In the incremental forming step S150 of this example embodiment, when the incremental forming apparatus 100 is moved in the horizontal direction, the rod-shaped tool 10 is moved such that the relational expression of the radius R, the moving amount P, and the pressing amount X of the rod-shaped tool 10 below is satisfied.

$$X = R - \sqrt{R^2 - \frac{P^2}{4}}$$

In this example embodiment, the radius R and the moving amount P of one pass of the rod-shaped tool 10 are set such that the pressing amount X will be equal to or less than 4.0 (μm). Therefore, in the incremental forming step S150, decoration of the finished surface of the workpiece W is able to be nice.

Figure 5:
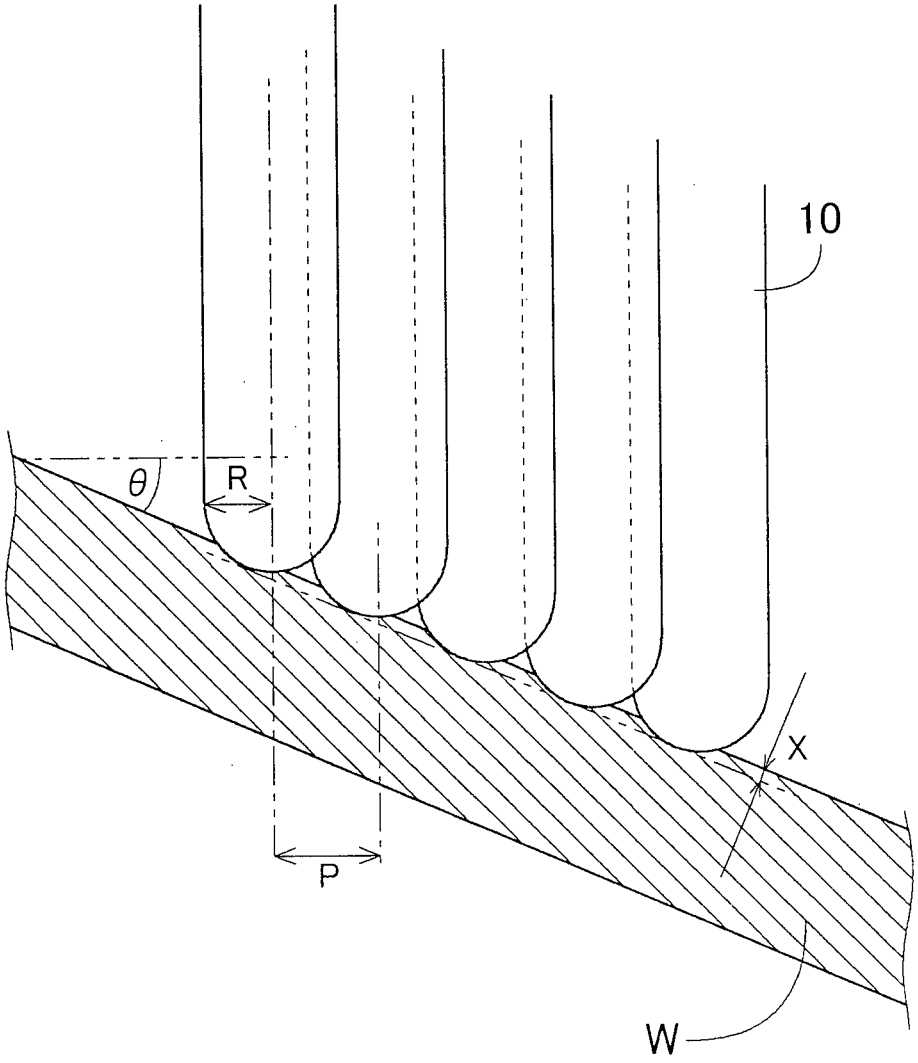
FIG. 5 is a sectional block diagram showing the relationship among the radius, the moving amount, and the pressing amount of the rod-shaped tool when there is an inclination.

Next, the relationship among the radius R, the moving amount P, the pressing amount X, and the inclination θ of the rod-shaped tool 10 will be described with reference to FIG. 5. FIG. 5 is a sectional view in the moving direction of the rod-shaped tool 10 (i.e., a direction inclined by θ with respect to the horizontal direction), of the flow of the incremental forming step S150.

In the incremental forming step S150 of this example embodiment, when the rod-shaped tool 10 is moved in a direction inclined by θ with respect to the horizontal direction, the rod-shaped tool 10 is moved such that the relational expression of the radius R, the moving amount P of one pass of the rod-shaped tool 10, and the pressing amount X of the one pass of the rod-shaped tool 10 below is satisfied.

$$X = R - \sqrt{R^2 - \frac{P^2}{4\cos^2\theta}}$$

In this example embodiment, the radius R and the moving amount P of the one pass of the rod-shaped tool 10 are set such that the pressing amount X is equal to or less than 4.0

(μm). Therefore, in the incremental forming step S150, decoration of the finished surface of the workpiece W is able to be nice.

Next, the effects of the incremental forming step S150 will be described. The incremental forming step S150 enables the dimensional change amount after forming to be reduced. That is, by forming the workpiece W such that the ironing ratio n will be within a range of 35% to 40%, inclusive (35%≤n≤40%), the dimensional change amount ΔT of the workpiece W is able to be made as small as possible.

Also, with the incremental forming step S150, the radius R and the moving amount P of the rod-shaped tool 10 are set such that the pressing amount X is equal to or less than 4.0 (μm). Therefore, decoration of the finished surface of the workpiece W is able to be nice.

Figure 6:
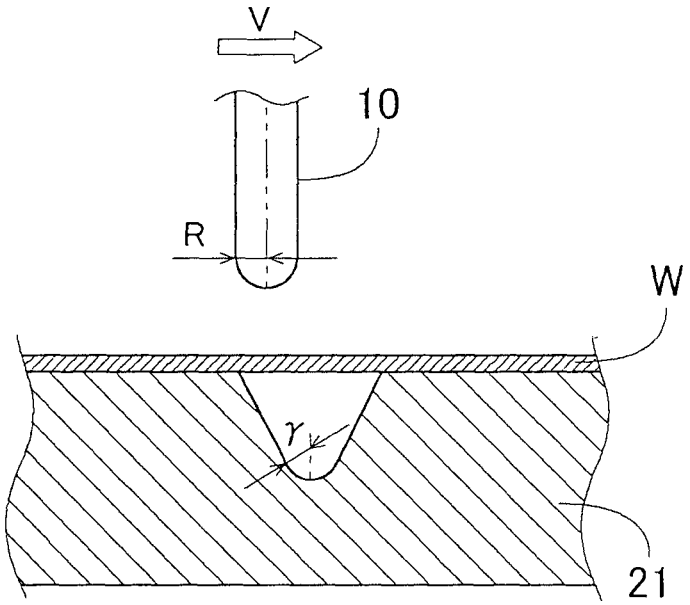
FIG. 6 is a sectional block diagram showing the relationship between a forming time t and a minimum radius of a workpiece.

Next, the relationship among a forming time t, a minimum radius r of the workpiece W, a tool path velocity V, and a tool path total distance Y will be described with reference to FIG. 6. FIG. 6 is a sectional view in the moving direction of the rod-shaped tool 10 (i.e., the horizontal direction), of the flow of the incremental forming step S150.

Normally, the radius R of the rod-shaped tool 10 is set by the minimum radius r of the workpiece W. Therefore, when the minimum radius r of the workpiece W is small, the radius R of the rod-shaped tool 10 is also small, so the moving amount P of the rod-shaped tool 10 also needs to be small. Here, the relationship among the forming time t, the minimum radius r of the workpiece W, the tool path velocity V, and a tool path total distance Y may be expressed by the expression below. In the expression, α is a coefficient.

$$t = \alpha \frac{Y}{Vr}$$

Figure 7:
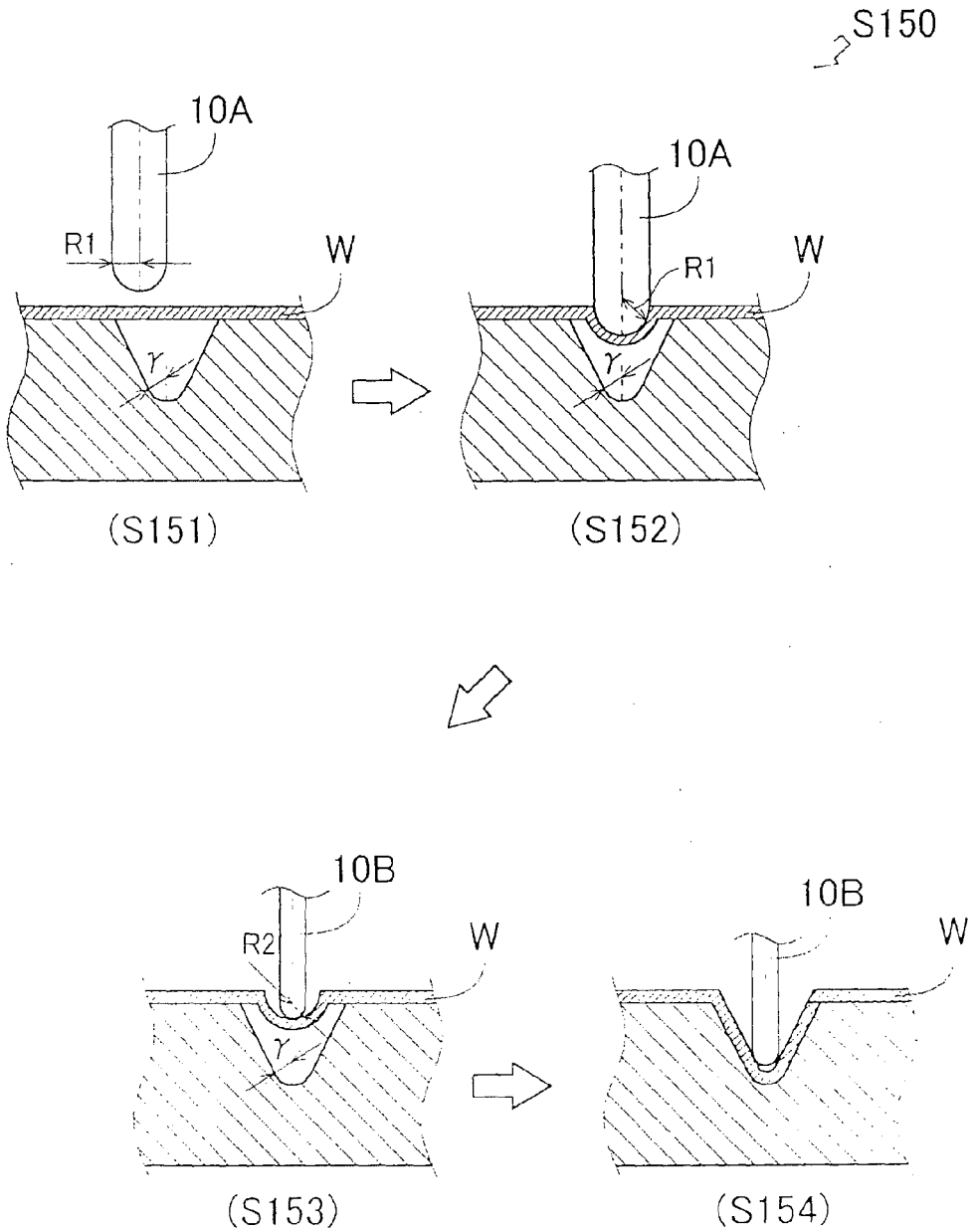
FIG. 7 is a view showing a frame format of the flow of an incremental forming step.

Next, the flow of the incremental forming step S150 will be described with reference to FIG. 7. FIG. 7 is a view showing a frame format of the flow of the incremental forming step S150.

In the incremental forming step S150, the workpiece W is formed by the incremental forming apparatus 100 described above.

In step S151, with the incremental forming apparatus 100, a rod-shaped tool 10A having a radius R1 that is larger than a radius R2 that is determined by the minimum radius r of the workpiece W is selected. In step S152, with the incremental forming apparatus 100, incremental forming is performed by the rod-shaped tool 10A having the radius R1 until the workpiece W is halfway to its final shape.

In step S153, with the incremental forming apparatus 100, the rod-shaped tool 10A is replaced with a rod-shaped tool 10B having the radius R2 that is determined by the minimum radius r of the workpiece W. In step S154, with the incremental forming apparatus 100, incremental forming is performed by the rod-shaped tool 10B having the radius R2 until the workpiece W reaches its final shape.

Now, the effects of the incremental forming step S150 will be described. The incremental forming step S150 of this example embodiment enables the forming time t to be shortened. That is, because the rod-shaped tool 10A having the radius R1 that is larger than the radius R2 that is determined by the minimum radius r of the workpiece W is selected and incremental forming is performed until the workpiece is halfway to its final shape, the forming time t is able to be shortened.

What is claimed is:

1. An incremental forming method comprising:

pressing a tip end of a rod-shaped tool into a metal plate with a pressing amount X; and stretching the metal plate little by little while moving the rod-shaped tool so that a percentage of decrease in plate thickness after incremental forming of the metal plate with respect to plate thickness before incremental forming of the metal plate is made to be within a range of 35% to 40%, inclusive, wherein the pressing amount X is equal to or less than 4.0 μm;

the rod-shaped tool has a hemisphere shape at a tip end portion of the rod-shaped tool;

a relationship among a radius of the tip end portion, a moving amount of one pass of the rod-shaped tool, and a pressing amount of the one pass of the rod-shaped tool is expressed by an expression $$X = R - \sqrt{R^2 - \frac{P^2}{4\cos^2\theta}}$$

where R represents the radius, P represents the moving amount, and X represents the pressing amount, and θ is an inclination of a direction in which the rod-shaped tool is moved with respect to a horizontal direction; and the radius of the tip end portion of the rod-shaped tool and the moving amount are set such that the pressing amount X is equal to or less than 4.0 μm.

* * * * *